United States Patent [19]

Bosque

[11] Patent Number: 4,699,028

[45] Date of Patent: Oct. 13, 1987

[54] SPINNER RATCHET WRENCH

[76] Inventor: Raul A. Bosque, 9029 Scott St., Bellflower, Calif. 90706

[21] Appl. No.: 893,550

[22] PCT Filed: Sep. 17, 1984

[86] PCT No.: PCT/US84/01484

§ 371 Date: Apr. 23, 1986

§ 102(e) Date: Apr. 23, 1986

[87] PCT Pub. No.: WO86/01764

PCT Pub. Date: Mar. 27, 1986

[51] Int. Cl.[4] ..... B25B 17/00

[52] U.S. Cl. ..... 81/57.22; 81/57.29; 81/63

[58] Field of Search ..... 81/57.29, 57.28, 57.12, 81/57.13, 57.22, 62, 63, 63.1, 63.2, 58.1; 192/43.1

[56] References Cited

U.S. PATENT DOCUMENTS

| | | | |
|---|---|---|---|
| 1,032,871 | 7/1912 | Bancroft | 81/62 |
| 1,680,515 | 8/1928 | Gormley | 81/63 |
| 3,733,936 | 5/1973 | Flynn | 81/57.29 |
| 4,086,829 | 5/1978 | Hudgins | 81/57.29 |
| 4,128,025 | 12/1978 | Main et al. | 81/57.29 |
| 4,277,989 | 7/1981 | Tracy | 81/62 |
| 4,318,314 | 3/1982 | Furedi | 81/57.29 |
| 4,592,256 | 6/1986 | Bosque | 81/57.29 |

*Primary Examiner*—Frederick R. Schmidt
*Assistant Examiner*—Bradley I. Vaught
*Attorney, Agent, or Firm*—Albert O. Cota

[57] ABSTRACT

A spinner ratchet wrench (10) having a normal ratcheting capability and a free-spinning mode used to easily and quickly pre-tighten a nut or bolt (device) prior to final tightening or to remove a device after it is initially loosened. This feature does not require the handle (18) to be oscillated and is particularly useful when devices are located in areas where finger manipulation is difficult or impossible. Free-spinning is achieved by a combination of a three-position pawl (22*a*) that includes a neutral position as well as the two standard ratchet positions, and a spinner drive shaft (18*a*) having at opposite ends a primary bevel gear (18*b*) and a spin knob (18*p*). When the pawl (22*a*) is placed in neutral it is disengaged from the ratchet gear (16*f*) allowing the shaft (18*a*) to be directly rotated by the knob (18*p*). As the shaft turns the primary bevel gear (18*b*) turns a secondary bevel gear (16*d*) connected to the socket shank (16*k*).

11 Claims, 11 Drawing Figures

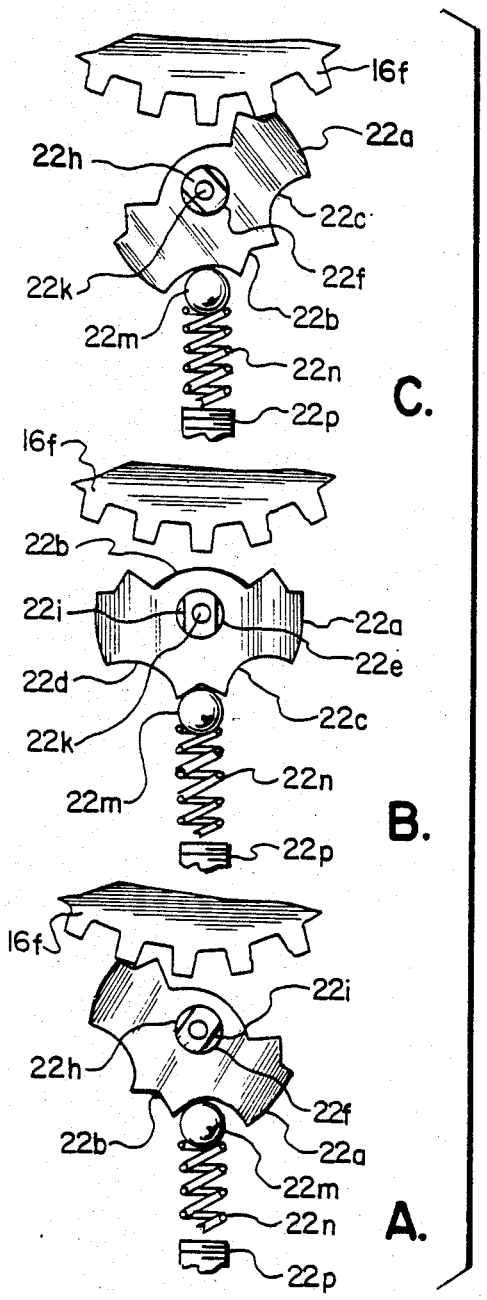
Fig.5.
Fig.6.
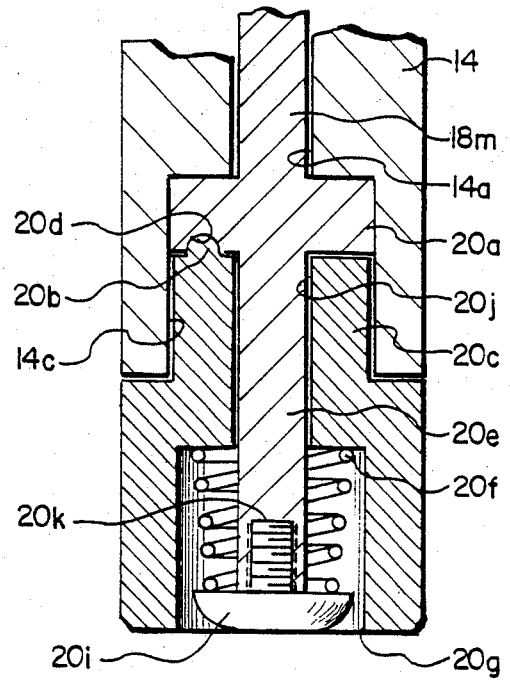
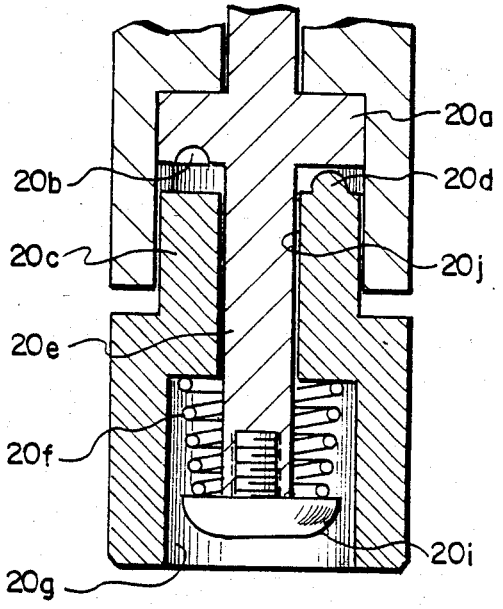
Fig.7.

SPINNER RATCHET WRENCH

TECHNICAL FIELD

The invention pertains to the general field of ratchet wrenches and more particularly to a wrench having conventional ratcheting capability as well as a free-spinning mode.

BACKGROUND ART

Ratchet wrenches having a mechanism for changing the direction of torque have been well known in the art for many years. Additionally, combination wrenches employing conventional ratcheting capability as well as a rotary movement of the socket shank that is independent of an oscillation of the handle have also been disclosed. The rotary movement, or as also referred to as a free-spinning mode, is used to either pre-tighten a nut or bolt until it becomes finger tight or to remove a nut or bolt after it has been broken loose by the ratchet section of the wrench.

Many of the patents disclosing wrenches with independent rotary motion describe complex mechanical designs requiring that a plurality of rotary drive elements, including the ratchet gear, be operated to produce the required free-spinning mode. Because of this mechanical complexity, the rotary drive may cause the wrench to bind or it may disengage under load from the drive mechanism causing a work stoppage and/or require a wrench repair. Additionally, the wrench wear-out rate is higher and it is more expensive to manufacture and maintain.

A search of the prior art did not disclose any patents that read directly on the claims of the instant invention. However, the following U. S. patents are considered related and indicative of the state-of- the-art:

| PATENT | INVENTOR | ISSUED |
|---|---|---|
| 4,318,314 | Furedi, E., et al | 9 March 1982 |
| 4,277,989 | Tracy, K. | 14 July 1981 |
| 4,086,829 | Hudgins, J. | 2 May 1978 |
| 3,733,936 | Flynn, W. | 22 May 1973 |

The Furedi patent discloses a ratchet wrench assembly that is used to unthread or thread a loosened nut or bolt from a threaded shaft. The wrench is comprised of a barrel assembly that includes a clutching mechanism that is connected to the drive shaft. Thus, rotation of the barrel assembly causes the drive shaft to rotate which, in turn, causes the drive stud to subsequently rotate in a responsive rotational direction.

The Tracy patent discloses a reversible ratchet wrench handle in which the actuator for the direction reversing mechanism is located close to the handle that is grasped by the user. This location permits the user to operate the actuator with the thumb of the hand holding the handle. Thus, changing the direction of operation of the wrench is a one handed rather than a two handed operation.

The Hudgins patent discloses a ratchet wrench having a rotational hand-grip speed-handle located around the wrench handle. A drive means is included within the handle that connects the hand-grip to the ratchet means located in the wrench head. The rotation of a nut or bolt is achieved by rotating the speed-handle about its own axis. This feature may be used for final tightening or after the nut or bolt has been broken loose and is being unthreaded for removal. Thus, the wrench may be used in a conventional manner for exerting maximum torque force or used in a screw-driver fashion when only minimum force is required.

The Flynn patent discloses a wrench having both a ratchet drive and a high speed gear drive that is connected to and activated by a rotational hand-grip. To apply a nut to a stud, the nut is initially placed in the socket attached to the shank. The hand-grip is then rotated which transmits the rotational movement of the hand-grip to the nut via a shaft, gears and the socket shank. When the nut is relatively tight, the force of hand hand-grip is released and the wrench handle is oscillated back and forth to effect a normal ratchet operation. To remove a nut, the above steps are reversed, the ratchet being used to loosen the nut until it turns freely and then the hand-grip is rotated to finish removing the nut.

DISCLOSURE OF THE INVENTION

The spinner ratchet wrench in addition to having a normal ratcheting capability also includes a free-spinning mode that is achieved without having the pawl engage the ratchet gear. The free-spinning mode is used to easily and quickly pre-tighten a nut or bolt prior to final tightening or to remove a nut or bolt after it has been broken loose. This feature is particularly useful when a nut or bolt is located in an area where removal of the nut or bolt by the finger would be difficult if not impossible.

The free-spinning mode is achieved by a combination of parts that includes a three-position pawl that has a neutral position as well as the normal loosening and tightening positions and a spinner shaft. The spinner shaft has on its front end a primary bevel gear that drives a secondary bevel gear attached to the socket shank and an integral spin knob on its opposite end that is used to manually rotate the shaft. The shaft and primary bevel gear are housed within the wrench handle and head housing with the spin knob extending behind the handle.

To place the wrench into the free-spinning mode the three-position pawl is placed in the neutral position by means of an easily accessible lever. When in neutral, the pawl is disengaged from the ratchet gear which allows the spinner shaft to rotate freely and subsequently directly rotate the socket shank in response to the rotation of the spin knob. Note that the spinning mode does not require the wrench handle to be oscillated back and forth which is important when the area being worked does not have sufficient lateral clearance to easily allow the wrench handle to be moved.

The primary object of the invention is to provide a free-spinning mode that can be easily and quickly set and that is accomplished by a direct power transfer from the primary bevel gear on the spinner shaft to the secondary bevel gear driving the socket shank. At no time during the free-spinning mode is the pawl or ratchet gear operative. In addition to this primary object the following additional objects are also considered relevant:

- to provide a design that is not cumbersome to use and that feels "good" to the user,
- to provide a three-position pawl that is easily and positively set in the selectable position,
- to provide a wrench design having a simple free-spinning drive that will not bind or be disengaged under load, to provide a wrench that will help prevent burns to the hands when working on hot parts such as those found in confined areas of an automobile engine, to provide a wrench that can be adapted to use commercially available sockets, to provide a wrench that is cost effective to manufacture and that is reliable and easy to maintain in the event of a malfunction.

These and other objects and advantages of the present invention will become apparent from the subsequent detailed description of the preferred embodiment and the claims taken in conjunction with the accompanying drawings.

DESCRIPTION OF THE DRAWINGS

The details of the invention are described in connection with the accompanying drawings in which:

FIGS. 5A, 5B and 5C are top views of the three-position pawl and the ratchet gear showing the normal ON-OFF ratcheting position and the center NEUTRAL position.

FIG. 6 is a cut-away view showing the clutch assembly in the engaged position.

FIG. 7 is a cut-away view showing the clutch assembly in the disengaged position.

BEST MODE FOR CARRYING OUT THE INVENTION

Figure 1:
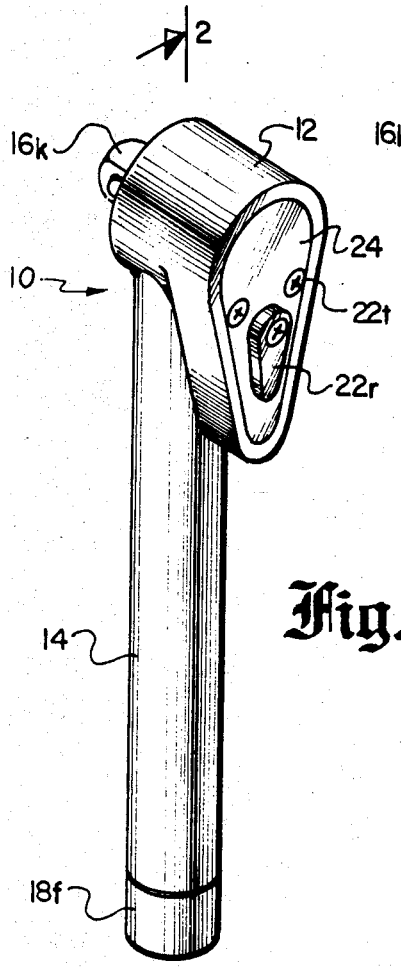
FIG. 1 is a perspective view of the improved spinner ratchet wrench.

The best mode for carrying out the improved spinner ratchet wrench 10 is presented in terms of a generic preferred embodiment and a second embodiment that modifies the generic design by the addition of a clutch assembly 20. The wrench 10 in the preferred embodiment, as best shown in FIGS. 1 through 3, is comprised of the following six major elements: a front housing 12, a handle 14, a bevel gear/ratchet gear assembly 16, a spinner drive assembly 18, a three-position pawl assembly 22 and a head housing cover 24.

Figures 8, 9:
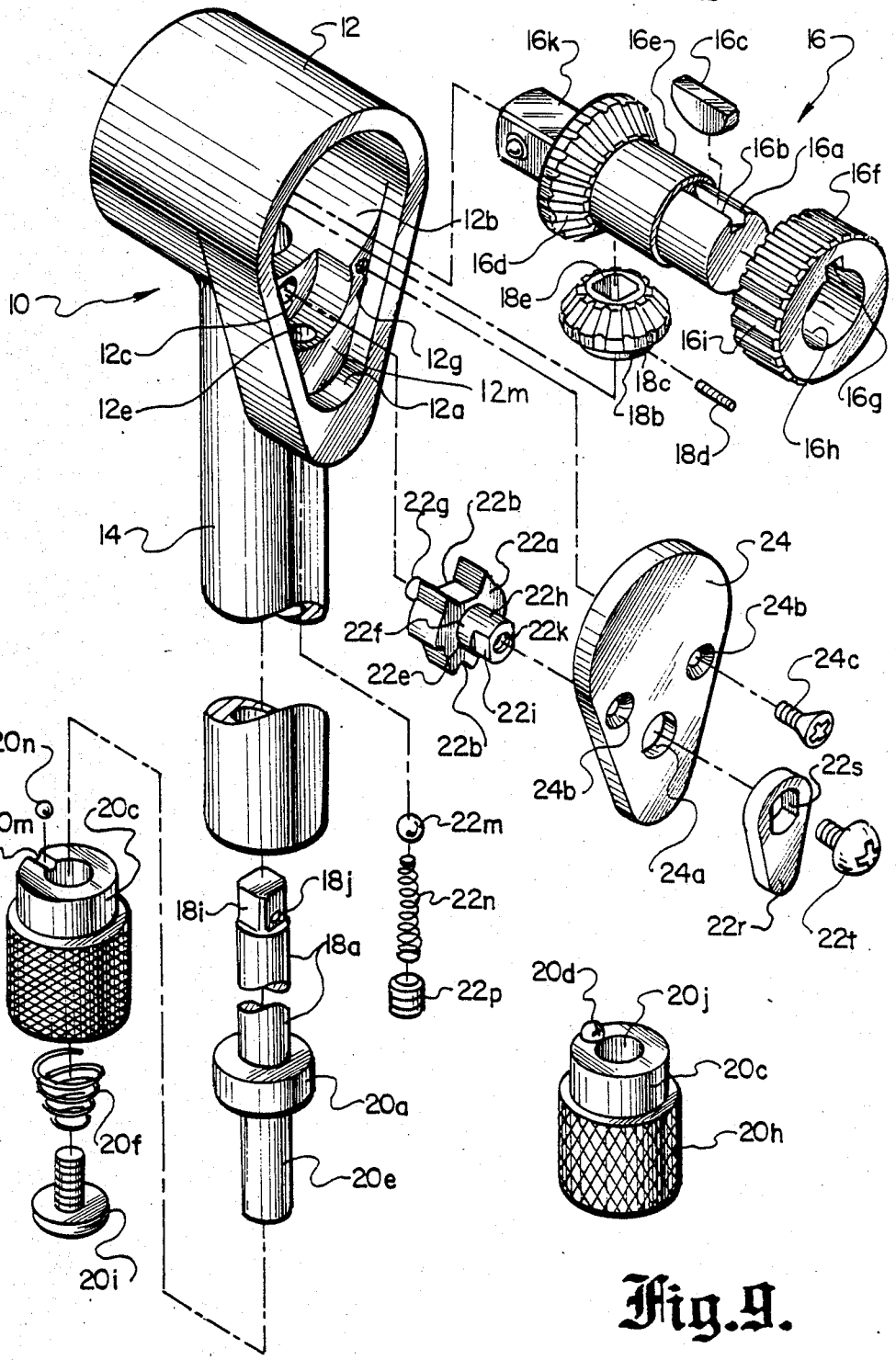
FIG. 8 is an exploded view of the overall wrench in the embodiment that includes the clutch assembly.
FIG. 9 is a perspective view of the back clutch plate/spin knob with a fixed male detent.

The front housing 12 houses the bevel gear/ratchet gear assembly 16, the primary bevel gear **18*b* and the three-position pawl assembly 22. Within the housing there is included a first housing cavity 12*a* that extends normal to the longitudinal axis of the wrench as shown in FIGS. 1 and 8. The bottom surface 12*m* of this first cavity has a set of housing cover threaded bores 12*g* and its wall thickness and configuration is designed to accommodate the head housing cover 24**.

Figure 2:
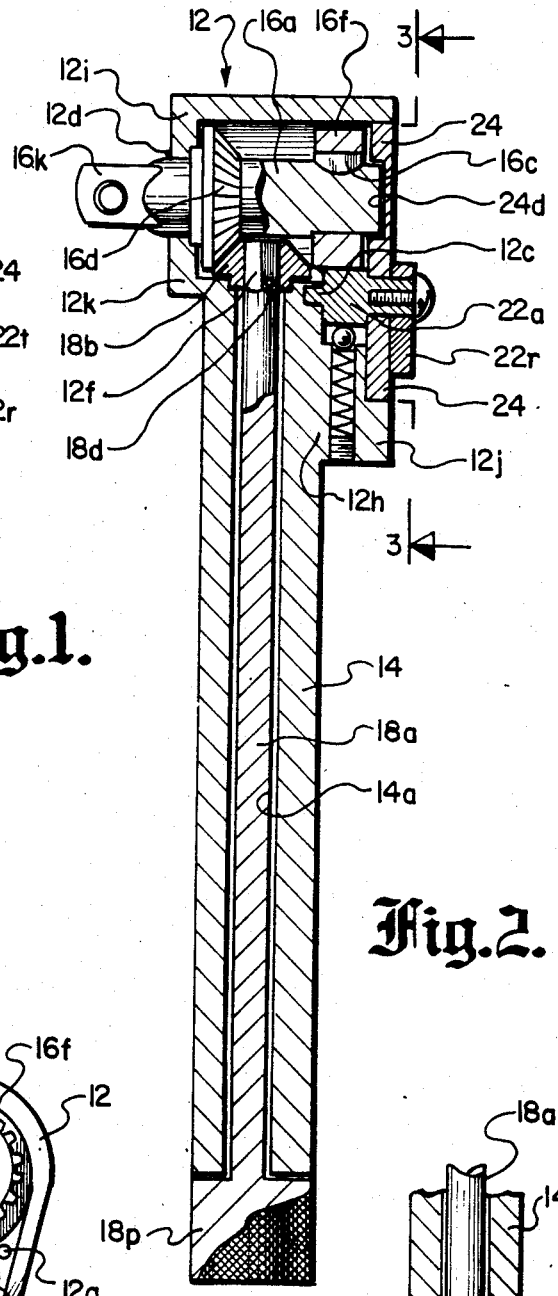
FIG. 2 is a cut-away side view of the preferred embodiment of the wrench.
Figure 3:
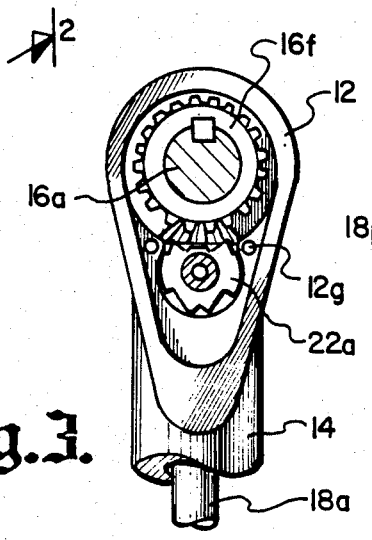
FIG. 3 is a sectional top view taken along lines 3—3 of FIG. 2.

After the first housing cavity **12*a* is completed a second housing cavity 12*b* that extends below the first cavity is machined as best shown in FIG. 2. The second cavity is comprised of the following wall placements and corresponding bores and cavities: a pawl lower shaft cavity 12*c* extending normal through an upper horizontal wall 12*h*; a bevel gear/socket shank bore cavity 12*d* extending normal through a lower horizontal wall 12*i*; a pawl ball-detent bore 12*e* extending normal through an upper vertical wall 12*j*; and a spinner drive shaft bore 12*f* extending normal through a lower vertical wall 12*k*. The surfaces of the cavities 12*c*, 12*d*** serve as bearing surfaces for their respective rotational elements.

The front housing 12 is covered by means of a head housing cover 24 dimensioned to flushly and tightly fit into the first housing cavity 12. The cover, as best shown in FIG. 9, has a pawl upper shaft bore **24*a* that is in alignment with the pawl lower shaft cavity 12*c* and a set of housing cover bolt bores 24*b*. The bottom side of the cover 24 has a gear connecting shaft centering cavity 24*d* that provides a bearing surface for the top of the gear connecting shaft 16*a*.**

After the cover 24 is set into the first housing cavity it is tightened by a set of machine screws 24 that are inserted into the housing cover bolt bores and housing cover threaded bores **12*g*** respectively. The housing as well as all other structural elements are constructed of cast or forged steel that has been heat treated and stress relieved as required.

The handle 14 which is used to manipulate the spinner ratchet wrench 10 is tubular in shape and extends longitudinally from the back of the front housing 12 as shown in FIGS. 1 and 2. In the preferred embodiment, the handle 14 and front housing are an integrally forged and machined component. However, a design where a separate handle 14 is welded to the front housing may also be employed.

The front end of the handle 14 abutts the exterior side of the lower vertical wall **12*k* and the upper surface of the handle 14 abutts the exterior side of the upper horizontal wall 12*h*. In the preferred embodiment, that is the non-clutch design, the handle has a single diameter shaft bore 14*a* extending therethrough that is in alignment with the spinner drive shaft bore 12*f* located on the lower vertical wall 12*k* of the front housing 12 as best shown in FIG. 2**.

The bevel gear/ratchet gear assembly 16 which provides the rotational drive and ratcheting capability to the invention is housed in the second housing cavity **12*b*. The assembly 16 includes a secondary bevel gear 16*d*, a ratchet gear 16*f* and a gear connecting shaft 16*a* where the outward/lower end of the shaft, that is the end that projects through the bevel gear/socket shank bore 12*d* on the housing 12, consists of a socket shank 16*k*. The socket shank is the preferred embodiment is $\frac{3}{8}$ inches (0.953 cm) however, the shaft size may be selected to accommodate any of the popular shank drive sockets. The upper end of the shaft 16*a* rotatably fits into the gear connecting shaft centering cavity 24*d* located on the bottom surface of the head housing cover 24 as best shown in FIG. 2**.

Rigidly connected by conventional means, to the lower end of the gear connecting shaft **16*a* is the secondary bevel gear 16*d*. The secondary bevel gear is positioned on the shaft to allow it to rest and/or rotate on the upper surface of the lower horizontal wall 12*i* located on the front housing 12. In the preferred embodiment none of the rotating interface surfaces, such as those of the bevel gear 16*d* and lower horizontal wall 12*i*,** are treated with a lubricated bearing surface nor are any self-lubricating inserts used. However, if desired a silicone impregnated interface surface may be used.

On the upper end of the gear connecting shaft **16*a* is located the ratchet gear 16*f* that, in the preferred embodiment, is longitudinally positioned within the shaft by means of a ratchet gear retaining sleeve 16*e* as best shown in FIG. 8. In lieu of the sleeve a tapered sleeve may also be used to longitudinally set and locate the ratchet gear on the shaft. The ratchet gear is rigidly connected to the shaft by cutting a shaft keyway 16b on the shaft and a corresponding gear keyway 16g on the ratchet gear 16f where into the keyways is inserted a woodruff key 16c**. Other attachment methods such as driving a pin through the ratchet gear and gear connecting shaft may also be employed.

The drive for the secondary bevel gear 16d is provided by the spinner drive assembly 18 which is comprised of a spinner drive shaft 18a having a primary bevel gear 18b at its front end and an integral spin knob 18p at its back end as best shown in FIG. 2. The primary bevel gear 18b is sized to mesh with and drive the secondary bevel gear 16d on the bevel gear/ratchet gear assembly 16. In assembling the elements the bevel gear/ratchet gear assembly 16 is initially set into the second housing cavity 12b where the secondary bevel gear 16d rests within the bevel gear/socket shank bore 12d. The primary bevel gear 18b, as best shown in FIG. 2, is then inserted into the cavity 12b and is positioned to mesh with the secondary bevel gear 16d in a 90-degree miter fashion. After the two gears are in place, the front end of the spinner drive shaft 18a is inserted into the shaft bore 12a on the handle 14 through the spinner drive shaft bore 12f and into the primary bevel gear square bore 18e. In the preferred embodiment, the primary bevel gear has a radially oriented threaded bore 18c located on the base section of the gear and the square bore 18e that fits a corresponding square end 18i on the front end of the spinner drive shaft 18a. The square end 18i also has a corresponding gear retaining hole 18j into which is inserted a set screw 18d that is first threaded into the gear bore 18c. Thus, rigidly and radially holding the primary bevel gear 18b on the drive shaft 18a.

The integral spin knob 18p which is knurled in the preferred embodiment, is used to manually rotate the spinner drive shaft 18a when the three-position pawl assembly is placed in the neutral position.

Figure 4:
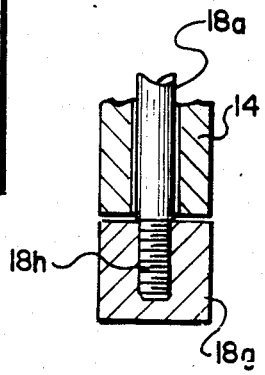
FIG. 4 is a cut-away side view of an alternate method of attaching the spin knob to the spinner drive shaft.

The knob 18p, as best shown in FIG. 2 is of the same diameter as the handle 14 and protrudes slightly from the end of the handle 14. A threaded spin knob 18g may also be employed as shown in FIG. 4. In this case the spinner drive shaft 18a has a threaded section 18h that allows the knob 18g to be attached.

The three-position pawl assembly 22 allows the spinner ratchet wrench to have a conventional ratchet wrench capability as well as a free-spinning neutral mode. The assembly 22, as best shown in FIG. 9, is comprised of a three-position pawl 22a and a pawl shaft 22f having a lower shaft end 22g and an upper keyed shaft end 22h. The lower shaft end is sized to rotatably fit into the pawl lower shaft cavity 12c located on the front housing 12; the upper keyed shaft 22h is sized to rotatably fit through the pawl upper shaft bore 24a located on the bottom surface of the head housing cover 24. The end of the upper shaft 22h has a pawl-lever bolt threaded bore 22k.

The three-position pawl 22a has a centrally located shaft bore 22e that is sized to allow the pawl to be inserted into the pawl shaft 22f as best shown in FIG. 9. The pawl 22a is rigidly held in place within the shaft by a pin or other conventional means. As shown in FIG. 5, the three-position pawl 22a has an ON detent position 22c that allows the wrench to tighten a bolt or nut as shown in FIG. 5A, an OFF detent position 22d that allows the wrench to loosen a bolt as shown in FIG. 5C and a center NEUTRAL position 22b, as shown in FIG. 5B. Note that when the three-position pawl 22a is in the NEUTRAL position the pawl is disengaged from the ratchet gear 16f.

The pawl 22a as best shown in FIG. 8 is manipulated by means of a pawl shifting lever 22r. The lever has a pawl upper shaft keyed bore 22s that is dimensioned to fit into the upper keyed shaft end 22h. The lever 22r is held in place by a lever bolt 22t that is threaded into the pawl-lever bolt threaded bore 22k.

The lateral pressure between the three-position pawl 22a and the ratchet gear 16f is maintained by a combination pawl detent ball 22m, a detent/ball spring 22n and a spring retaining screw 22p. The pawl detent ball is sized to slideably fit into the pawl detent bore 12e located on the front housing 12 and into one of the selectable three pawl detents 22b, 22c, or 22d. The detent/ball spring 22n is likewise sized to slideably fit into and to compressively hold the pawl detent ball 22m within the pawl ball-detent bore. After the ball and spring are inserted the spring retaining screw 22p is threaded into the threaded pawl ball-detent bore to compressively hold the elements. The tension on the ball 22m which, in turn, controls the pawl/ratchet gear pressure, is permanently set at the time the wrench is manufactured. However, if necessary it may be adjusted by threading the spring retaining screw 22p in and out as desired.

The generic spinner ratchet wrench 10 as previously described may be modified by the inclusion of the clutch assembly 20 which allows a combination back clutch plate spin knob 20c to be manually rotated until the nut or bolt becomes finger tight at which point the clutch will slip and will rotate without imparting any further torque to the nut or bolt. When this slippage occurs, it is an indication to the user that the ratchet section of the wrench should be used to complete the tightening by switching the pawl shifting lever 22r to the ON position. The incorporation of the clutch assembly 20 requires changes to the handle 14, the spinner drive shaft 18a, and the spin knob 18p.

The handle 14 in this embodiment requires that a clutch plate cavity 14c be included at the lower end of the handle as best shown in FIGS. 6 and 7.

The spinner drive assembly 18 has a similar front configuration as previously described. However, the back section includes a larger diameter disk that serves as the forward clutch plate 20a. The backside of the forward clutch plate has a female detent 20b near the clutch's plate perimeter as shown in FIGS. 6 and 7. Integrally extending from the backside of the forward clutch plate 20a is a centrally located clutch shaft 20e that has at its end a retaining bolt threaded bore 20k.

The combination back clutch plate spin knob 20c, as shown in FIGS. 6, 7 and 9 in its preferred embodiment, has on its front side a male detent 20d located and sized to fit into the female detent 20b located on the forward clutch plate 20a. The back clutch plate also includes a clutch shaft bore 20j as shown in FIGS. 6 and 7, having a diameter slightly greater than that of the clutch shaft 20e; and a clutch spring cavity 20g extending from its backside. An alternate male detent configuration employing a back clutch plate spin knob having a groove 20m, as shown in FIG. 8, which loosely retains a stainless steel ball 20n may also be used.

The back clutch plate spin knob 20c is compressively held against the forward clutch plate 20a by a clutch spring 20f that is inserted over the clutch shaft 20e and within the clutch spring cavity 20*g*. The spring 20*f* is held in compression by the shaft/clutch retaining bolt 20*i* that is threaded into the threaded bore 20*k* located on the clutch shaft 20*e*.

The clutch in the engaged position is shown in FIG. 6. When the clutch is engaged and the three-position pawl 22*a* is placed in the NEUTRAL position the back clutch plate spin knob 20*c* may be rotated to apply a direct power transfer from the knob to the nut or bolt being tightened. Conversely, when the rotational torque exceeds the clutch's holding torque, the clutch will disengage as shown in FIG. 7 and the back clutch plate spin knob will continue to rotate pass the detents 20*b*, 20*d* without imparting any torque to the socket shank 16*k*.

An alternate friction-plate clutch configuration (not shown) can also be used in lieu of the detent configuration used in the above described clutch assembly 20. In this alternate configuration, a friction plate (clutch) is sandwiched between a modified forward clutch plate 20*a* and back clutch plate/spin knob 20*c*. The amount of torque produced by the plate is controlled by the amount of tension produced by the spring 20*f*.

OPERATION

The spinner drive wrench 10 can be used as either a conventional two position ratchet wrench or as a wrench having a manually controlled free-spinning shank drive. To use the wrench 10 in the free-spinning mode all that is required is to set the pawl shifting lever 22*r* in the center NEUTRAL position. In this position, the three-position pawl 22*a* is disengaged from the ratchet gear 16*f* which allows the spinner drive shaft 18*a* to be freely rotated by manually rotating the spin knob 18*f*. This inventive feature allows the wrench user to quickly pre-tighten a nut or bolt prior to final torqueing or to quickly loosen and remove the nut or bolt after it is initially loosened. The free-spinning mode is particularly useful when such nuts or bolts are located in areas where finger manipulation may be difficult or impossible.

While the invention has been described in complete detail and pictorially shown in the accompanying drawings, it is not to be limited to such details, since many changes and modifications may be made to the invention without departing from the spirit and the scope thereof. Hence, it is described to cover any and all modifications and forms which may come within the language and scope of the claims.

I claim:

1. A spinner ratchet wrench comprising:

A. a front housing further comprising:

(1) a first housing cavity extending normal to the longitudinal axis of said spinner ratchet wrench with said first cavity bottom surface having a set of housing cover threaded bores, (2) a second housing cavity having an upper horizontal wall, a lower horizontal wall, an upper vertical wall and a lower vertical wall where said second cavity extends below said first cavity normal to the longitudinal axis of said spinner ratchet wrench where said second housing cavity further comprises:

(a) a pawl lower shaft cavity extending normal through said upper horizontal wall, (b) a level gear/socket shank bore/cavity extending normal through said lower horizontal wall, (c) a pawl ball-detent bore extending normal through the upper vertical wall, and (d) a spinner drive shaft bore extending normal through the lower vertical wall, B. a head housing cover dimensioned to flushly and tightly fit into said first housing cavity with said cover having a pawl upper shaft bore in alignment with said pawl lower shaft cavity, having a set of housing cover bolt bores in alignment with said set of housing cover threaded bores located on said front housing, a set of machine screws that fit into the housing cover threaded bolt bores, and with said bottom side of said housing cover having a gear connecting shaft centering cavity, C. a handle extending longitudinally from the back of said front housing with front end of said handle abutting the exterior side of said vertical wall and upper surface of said handle butting the exterior side of said upper horizontal wall and with said handle having a shaft bore therethrough that is in alignment with said spinner drive shaft bore, D. a bevel gear/ratchet gear assembly housing within said second housing cavity where said bevel gear/-ractchet gear assembly further comprises:

(1) a gear connecting shaft where outward/lower end of said shaft consists of a socket shank that extends through the bevel gear/socket shank bore on said front housing and where upper end rotatably fits into the gear connecting shaft centering cavity in said head housing cover, (2) a secondary bevel gear rigidly connected to lower end of gear connecting shaft and positioned on said shaft to allow said gear to rotatably rest on upper surface of said lower horizontal wall of said front housing, (3) a ratchet gear having means to be non-rotatably connected to the upper section of said gear connecting shaft and means to be longitudinally positoned within said gear connecting shaft, E. a spinner drive assembly inserted into the shaft bore on said handle and through said spinner drive shaft bore on said front housing where said spinner assembly comprises:

(1) a spinner drive shaft having a front end and a back end, (2) a primary gear having means to be rigidly attached to front end of said spinner drive shaft where said primary bevel gear is positioned and sized to mesh with the secondary bevel gear on said bevel gear/ratchet gear assenbly, (3) a spin knob integrally located at the back end of said spinner drive shaft where knob protrudes slightly from the end of handle, F. a three-position pawl assembly comprising:

(1) a pawl shaft having a lower shaft end and an upper keyed shaft end where the lower shaft end is sized to rotatably fit into said pawl lower shaft cavity located on said front housing and where upper keyed through the pawl upper shaft bore on said head housing cover and with said upper shaft end having a pawl-lever bolt threaded bore therein, (2) a three-position pawl having a shaft bore therethrough sized to be inserted into said pawl shaft and having means to be rigidly held within said shaft, where said pawl has an ON detent position, an OFF detent position, and a center NEUTRAL position where when said pawl is in the neutral position, it is disengaged from the ratchet gear, (3) a pawl shifting lever having a pawl upper shaft keyed bore dimensioned to fit into the upper keyed shaft end on said pawl shaft where said lever is held in place by a lever bolt that is threaded into the pawl-lever bolt threaded bore, (4) a pawl detent ball sized to slideably fit into the pawl detent bore on said front housing and into one of the three detents on said three position pawl assembly, (5) a detent/ball spring sized to slideably fit into and hold the pawl detent ball within the pawl ball-detent bore, (6) a spring retaining screw sized to fit into the threaded pawl ball-detent bore to compressively hold the detent/ball spring.

2. The spinner ratchet wrench as specified in claim 1 wherein said front housing and said handle are constructed of a single integral piece.

3. The spinner ratchet wrench as specified in claim 1 wherein said means to rigidly connect said ratchet gear to upper section of said gear connecting shaft is accomplished by having a shaft keyway on said gear connecting shaft and a corresponding gear keyway on said ratchet gear into which keyways is inserted a woodruff key.

4. The spinner ratchet wrench as specified in claim 1 wherein said means to longitudinally position said ratchet gear within said gear connecting shaft is accomplished by inserting into said shaft a ratchet gear retaining sleeve.

5. The spinner ratchet wrench as specified in claim 1 wherein said primary bevel gear is rigidly attached to front end of said spinner drive shaft by employing a bevel gear having a radially oriented gear threaded bore therethrough into which is threaded a setscrew that makes contact with the surface of said spinner drive shaft.

6. The spinner ratchet wrench as specified in claim 1 wherein said spinner drive shaft has a threaded section at its back end onto which is attached a compatible threaded spin knob.

7. An improved spinner ratchet wrench comprising:

A. a front housing further comprising:

(1) a first housing cavity extending normal to the longitudinal axis of said spinner ratchet wrench with said first cavity bottom surface having a set of housing cover threaded bores, (2) a second housing cavity having an upper horizontal wall, a lower horizontal wall, an upper vertical wall and a lower vertical wall where said second cavity extends below said first cavity normal to the longitudinal axis of said spinner ratchet wrench where said second housing cavity further comprises:

(a) a pawl lower shaft cavity extending normal through said upper horizontal wall, (b) a bevel gear/socket shank bore/cavity extending normal through said lower horizontal wall, (c) a pawl ball-detent bore extending normal through the upper vertical wall, and (d) a spinner drive shaft bore extending normal through the lower vertical wall, B. a head housing cover dimensioned to flushly and tightly fit into said first housing cavity and with said cover having a pawl upper shaft bore in alignment with said pawl lower shaft cavity and also having a set of housing cover bolt holes in alignment with said set of housing cover threaded bores located on said front housing, with said bottom side of said housing cover having a gear connecting shaft centering cavity, C. a handle extending longitudinally from the back of said front housing with front end of said handle abutting the exterior side of said lower vertical wall and upper surface of said handle abutting the exterior side of said upper horizontal wall and with said handle having a shaft bore therethrough that is in alignment with said spinner drive shaft bore, and with back of handle having a clutch plate cavity, D. a bevel gear/ratchet gear assembly housed within said second housing cavity where said bevel gear/-ratchet gear assembly further comprises:

(1) a gear connecting shaft where outward/lower end of said shaft consists of a socket shank that extends through the bevel gear/socket shank bore on said front housing and where upper end rotatably fits into gear connecting shaft centering cavity in said head housing cover, (2) a secondary bevel gear positioned longitudinally within the lower end of said gear connecting shaft to allow said gear to rotatably rest on upper surface of said lower horizontal wall of said front housing, (3) a ratchet gear having means to be non-rotatably connected to the upper section of said gear connecting shaft and means to be longitudinally positioned within said gear connecting shaft, E. a spinner drive assembly inserted into the shaft bore on said handle and through said spinner drive shaft bore on said front housing where said spinner drive assembly comprises:

(1) a spinner drive shaft having a front end and a back section, (2) a primary bevel gear having means to be rigidly attached to front end of said spinner drive shaft where said primary bevel gear is positioned and sized to mesh with the secondary bevel gear on said bevel gear/ratchet gear assembly, (3) a clutch assembly comprising:

(a) a forward clutch plate that is an integral part of the back section of said spinner drive shaft, with back side of said forward clutch plate having a female detent near the clutch plate perimeter, (b) a clutch integrally extending from the back side of said forward clutch plate with end of said shaft having a retaining bolt threaded bore, (c) a combination back clutch plate spin knob having on its front side a male detent located and sized to fit into the female detent on the forward clutch plate and also having a clutch shaft bore therethrough and a clutch spring cavity extending from its back side, (d) a clutch spring inserted over the clutch shaft within the clutch spring cavity, (e) a shaft/clutch retaining bolt that is sized to compressively hold the clutch spring when said bolt is threaded into the threaded bore on said clutch shaft, F. a three-positioned pawl assembly comprising:

(1) a pawl shaft having a lower shaft end and an upper keyed shaft end where the lower shaft end is sized to rotatably fit into said pawl lower shaft cavity located on said front housing and where upper keyed shaft end is sized to rotatably fit through the pawl uppper shaft bore on said head housing cover and with said upper shaft end having a pawl-lever bolt threaded bore therein, (2) a three-position pawl having a shaft bore therethrough sized to be inserted into said pawl shaft and having means to be rigidly held within said shaft, where said pawl has an ON detent position, an OFF detent position, and a center NEUTRAL detent position where when said pawl is in the neutral position, it is disengaged from the ratchet gear, (3) a pawl shifting lever having a pawl upper shaft keyed bore dimensioned to fit into the upper keyed shaft end on said pawl shaft where said lever is held in place by a lever bolt that is threaded into the pawl-lever bolt threaded bore, (4) a pawl detent ball sized to slideably fit into the pawl detent bore on said front housing and into one of the three detents on said three position pawl assembly.

8. The spinner ratchet wrench as specified in claim 7 wherein said front housing and said handle are constructed of a single integral piece.

9. The spinner ratchet wrench as specified in claim 7 wherein said means to rigidly connect said ratchet gear to upper section of said gear connecting shaft is accomplished by having a shaft keyway on said gear connecting shaft and a corresponding gear keyway on said ratchet gear into which keyway is inserted a woodruff key.

10. The spinner ratchet wrench as specified in claim 7 wherein said means to longitudinally position said ratchet gear within said gear connecting shaft is accomplished by inserting into said shaft a ratchet gear retaining sleeve.

11. The spinner ratchet wrench as specified in claim 7 wherein said primary bevel gear is rigidly attached to front end of said spinner drive shaft by employing a bevel gear having a radially oriented threaded bore therethrough into which is threaded a set-screw that makes contact with the surface of said spinner drive shaft.

* * * * *